US006884005B1

(12) United States Patent
Seegmiller

(10) Patent No.: US 6,884,005 B1
(45) Date of Patent: Apr. 26, 2005

(54) ROOF SUPPORT TRUSS

(76) Inventor: Ben L. Seegmiller, 143 S. 400 East, Salt Lake City, UT (US) 84111

( * ) Notice: Subject to any disclaimer, the term of this patent is extended or adjusted under 35 U.S.C. 154(b) by 0 days.

(21) Appl. No.: 10/871,924

(22) Filed: Jun. 18, 2004

(51) Int. Cl.[7] ..... E21D 21/00
(52) U.S. Cl. ..... 405/288; 405/302.1; 405/302.2
(58) Field of Search ..... 405/288, 302.1, 405/302.2, 302.3

(56) References Cited

U.S. PATENT DOCUMENTS 5,222,837 A * 6/1993 Phillips ..... 405/288
5,415,498 A * 5/1995 Seegmiller ..... 405/288
5,466,095 A * 11/1995 Scott ..... 405/302.2
5,755,535 A * 5/1998 Fox ..... 405/288

* cited by examiner

*Primary Examiner*—Frederick L. Lagman
(74) *Attorney, Agent, or Firm*—Todd E. Zenger; Kirton & McConkie

(57) ABSTRACT

Mine strata roof support components and truss comprising a mine roof support bracket with a roof bolt sleeve, a tie rod channel and a tool mount, the tool mount being coaxial with the roof bolt sleeve. These components permit the construction of a truss which can be installed quickly and safely to secure the mine strata. The present invention permits simultaneous installation of the roof bolt and bracket.

20 Claims, 10 Drawing Sheets

ROOF SUPPORT TRUSS

FIELD OF THE INVENTION

The present invention relates to new and useful mine strata support structures, components and systems thereof, and, more particularly, presents a mine roof truss bracket that can be mechanically inserted into a mine strata together with a roof bolt by coupling a terminal member of the bracket to an insertion tool.

BACKGROUND OF THE INVENTION

Different types of trussing structure, whether active or passive or both, have previously been devised and extensively used in underground mines. A variety of brackets and connectors of prior design have been employed for achieving the trussing and/or support function desired.

One such structure is disclosed in the inventor's prior U.S. Pat. No. 5,544,982 entitled "Mine Strata Support Structure." This prior art reference discloses mine roof support brackets that require multiple components and can be cumbersome and/or dangerous to insert into mine strata. Indeed, when a miner extends his drift or tunnel into unsupported areas, time is of the essence in getting a support structure in place. The prior art device provides a less expeditious and safe way to securely insert a mine roof bracket into the mine strata.

Accordingly, the present invention includes mine brackets which couple to anchor or roof bolts and can be rapidly and safely inserted into the mine strata, using a single piece of insertion equipment which inserts the roof bolt and roof bracket in a single rotational motion. This is accomplished by providing a novel, bi-axial bracket, with a projection extending one axis which projection directly coupled to the mine roof bolt insertion equipment and which projection can sustain the high rotational forces needed to insert a roof bolt. This bracket coupled to tie-rods and joined to other brackets provides an improved truss system.

SUMMARY OF THE INVENTION

The present invention is an improved roof truss system comprising a bi-axial mine roof support bracket. The present invention teaches a device that improves the safety and efficiency of mine operation by proving a device and method for supporting a mine roof while reducing the risk to miners. To improve the safety and efficiency of a mine, the present invention provides a mine roof bracket having a roof bolt receiving sleeve along a first axis, a tie-rod receiving channel along a second axis and integrally fixed to the roof bolt sleeve; and an equipment or tool mount extending away from the bracket along the first axis. The equipment mount allows a miner to insert a roof bolt and bracket into the mine strata with a single motion. A tie-rod is placed in the bracket's tie-rod receiving channel to construct truss systems.

DETAILED DESCRIPTION OF THE INVENTION

Figure 1:
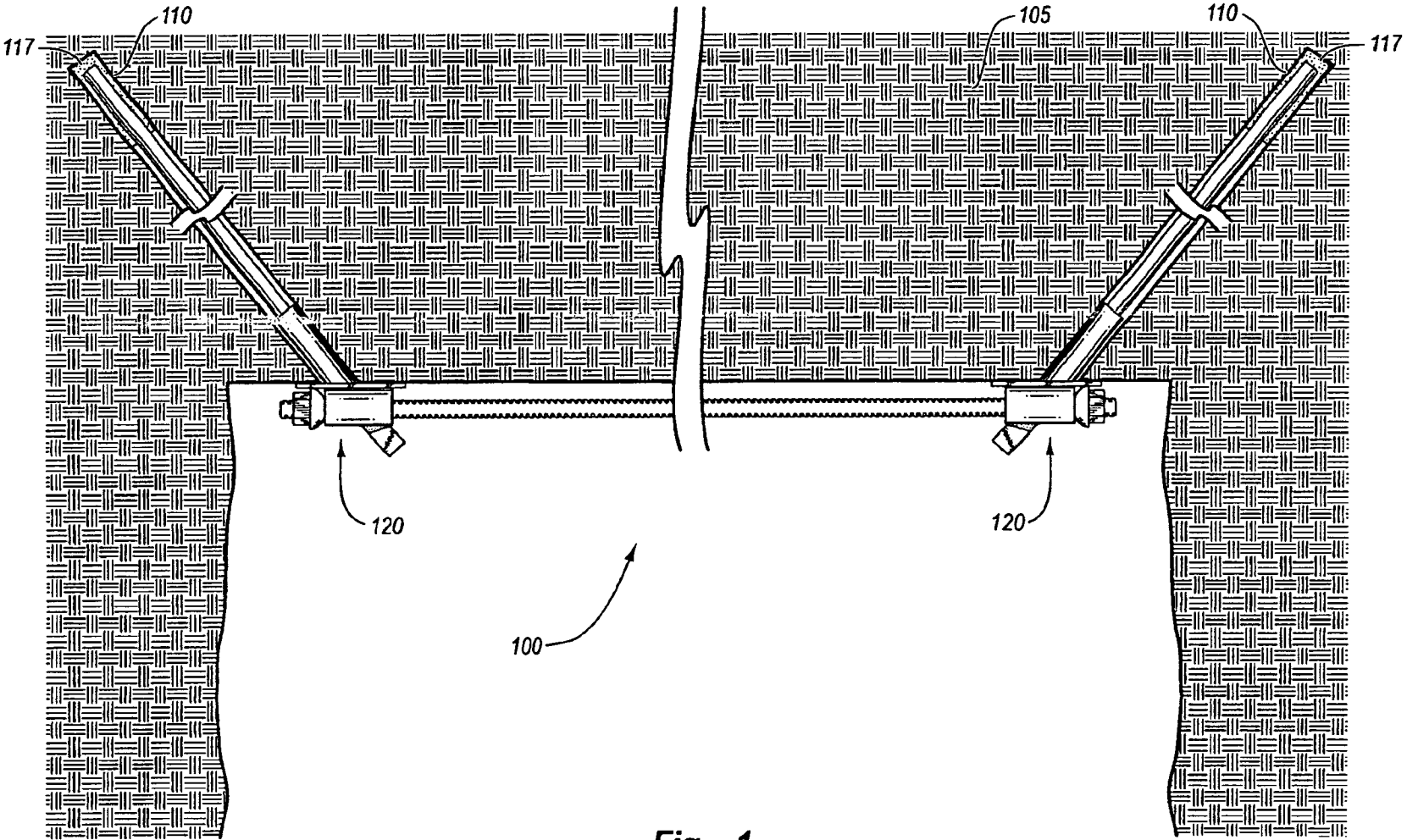
FIG. 1 illustrates a support a truss inserted into a mine strata.
Figures 2, 3:
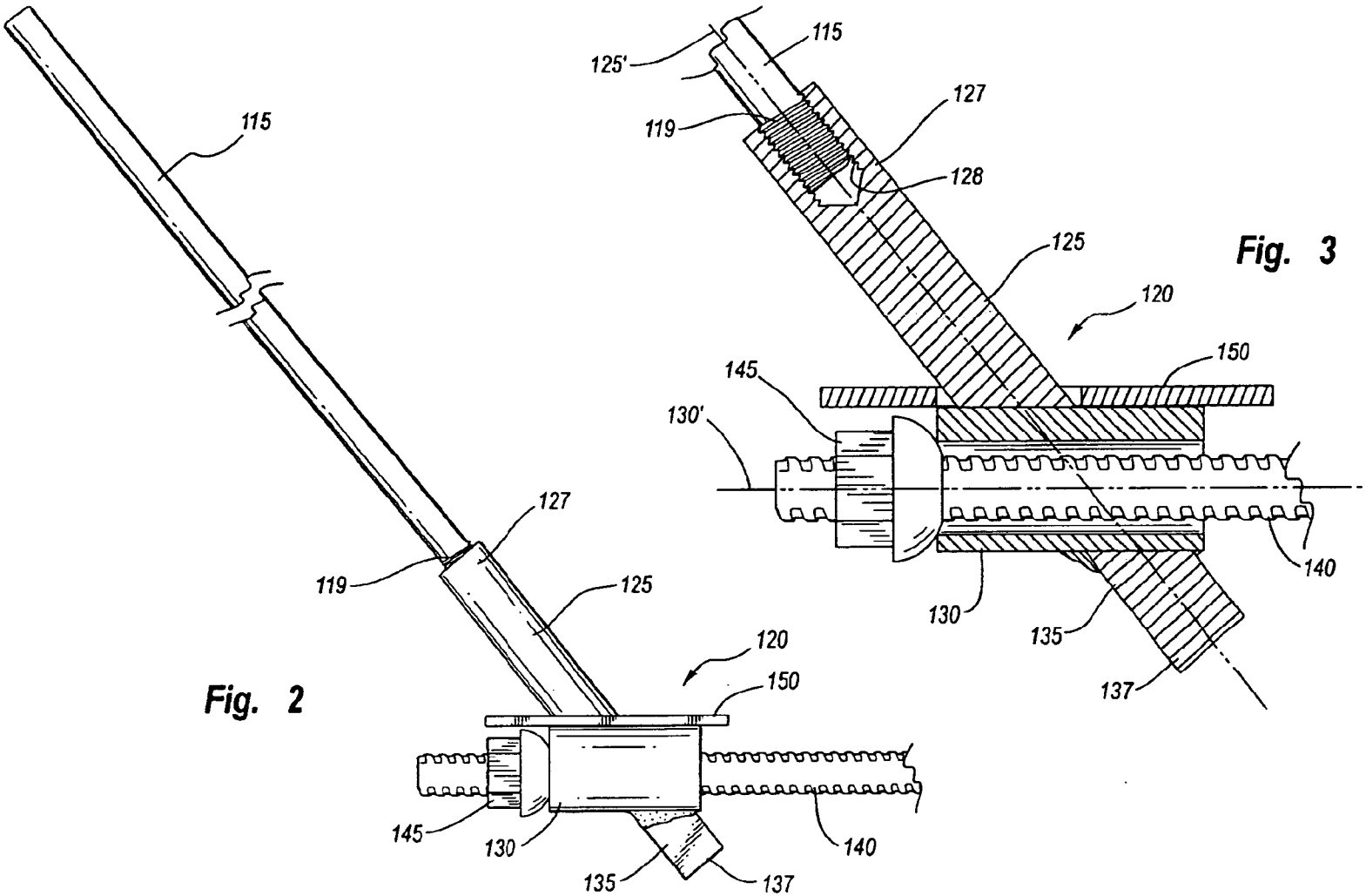
FIG. 2 illustrates a perspective view of the embodiment of the present invention.
FIG. 3 illustrates a cross-sectional view of the apparatus of FIG. 2.

Referring to FIGS. 1, 2 and 3, depicted is an improved roof support truss 100 used to support a mine strata 105 and its associated roof bolt holes 110 and roof bolts 115. Anchor or roof bolts 115 may be made of steel such as rebar, threaded rebar or other steel shafts, or it may be made of any other metal or polymer capable of supporting high loads. Roof bolts 115 are secured in the mine strata using a variety of methods commonly known in the art, such as an epoxy resin, friction, or mechanically coupling the roof bolt in the strata. Where a known two-component epoxy resin is used, the components of the resin are inserted in the pre-drilled holes 110. When the roof bolt is inserted into holes 110 and vigorously rotated, the two components mix, thus forming an epoxy resin 117 to cement roof bolt(s) 115 in place.

Bracket 120 comprises a roof bolt coupling sleeve 125 along a first or primary axis 125'. Coupling sleeve 125 receives or bears roof bolt 115. Bracket 120 also comprises tie-rod channel 130 along a second axis 130'. The tie-rod channel 130 receives tie-rod 140. Bolt coupling sleeve 125 and tie-rod channel 130 are integrally connected so as to form a single bracket. Sleeve 125 and channel 130 may be fixed by any methods commonly known in the art such as welding, machining the bracket from a single piece, die casting the bracket as a single piece, or any combination thereof. Bracket 120 also comprises a projection 135.

Bolt sleeve 125 comprises a threaded end 127 for receiving the roof bolt 115 along axis 125'. Coupled or integral to roof bolts 115 is a mine roof support bracket 120. Roof bolt 115 can be joined or coupled to bracket 120 using bolt threads 119 and sleeve threads 128 or any other mechanism known in the art.

Projection 135 comprises a terminal end or tool or equipment mount 137 along primary axis 135' configured to receive or be received by existing mining or drilling equipment which can be used to install and/or rotate bracket 120 and bolt 115 about axis 125'. Tool mount 137 may be either a male or female adaptor for coupling, and may be any number of shapes, including but not limited to, a square, a star pattern, or any other number of shapes compatible with installation equipment and capable of supporting the rotational force exerted when inserting the anchor bolts 115 and the mine roof support bracket 120 into the pre-drilled holes 110. Sleeve 125 and projection 135 are coaxial or substantially coaxial along axis 125. Thus bracket 120 with attached bolt 115 may be inserted into hole 110 of mine strata 105 and secured in place in one simultaneous, rotational installation about axis 125'.

Thus, by integrally fixing bolt sleeve 125 and equipment mount 137 along primary axis 125' with the tie-rod channel 130 along secondary axis 130', the present invention provides mine workers with an apparatus and system which can quickly and easily set up an improved roof support truss 100 by handling fewer parts and with less insertion steps and physical effort. By connecting bracket 120 and roof bolt 115 to each other and to a piece of existing drilling or mining tool via tool mount 137 for simultaneous insertion, roof truss mine safety and installation efficiency are improved.

Figure 3A:
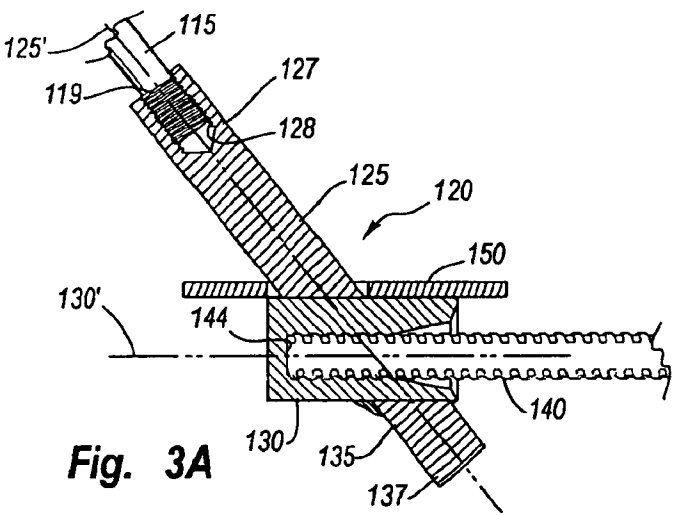
FIG. 3A illustrates an alternative embodiment of the apparatus of FIG. 3.
Figure 4:
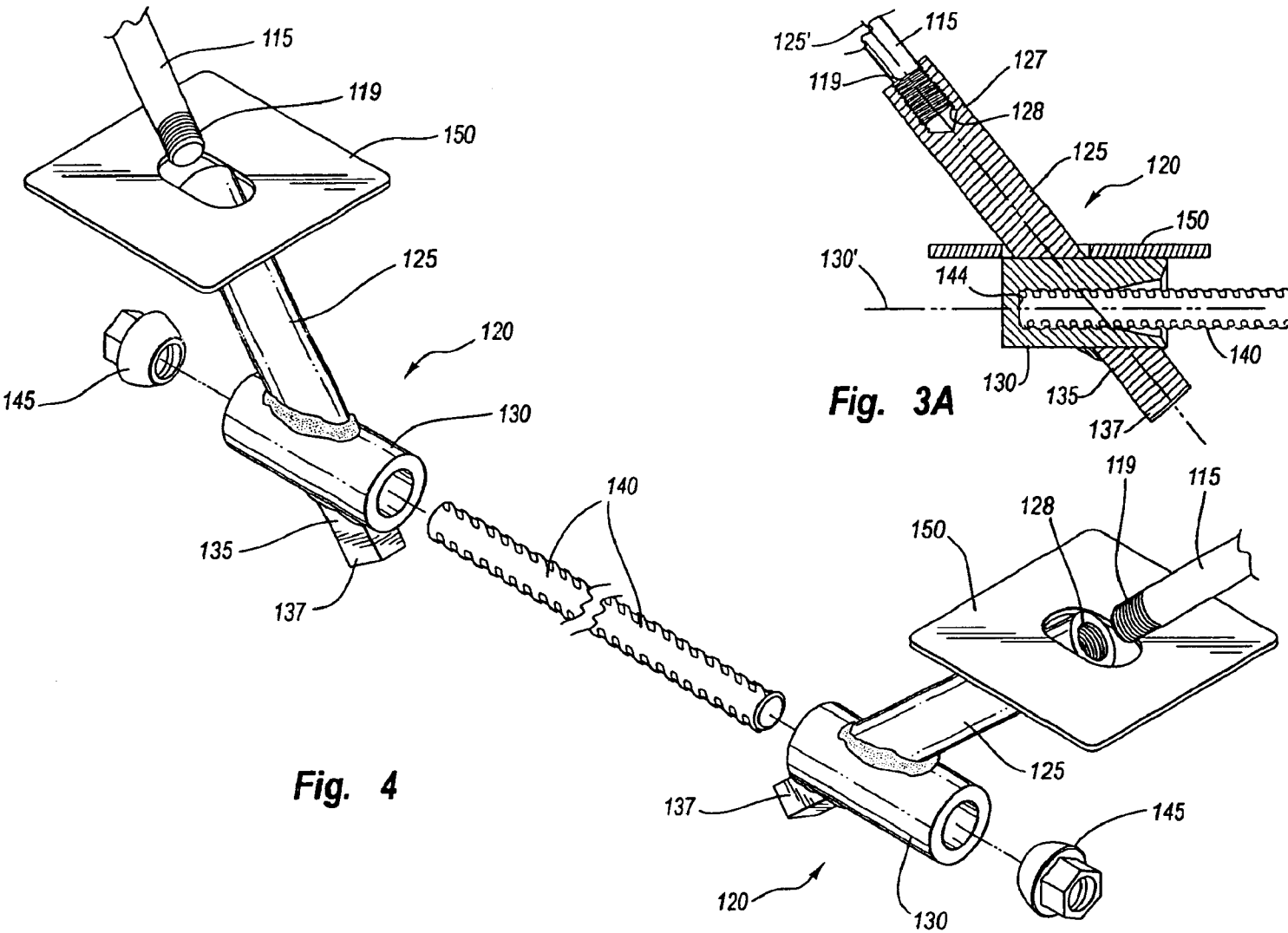
FIG. 4 illustrates an exploded view of the embodiment of FIGS. 2 and 3 utilized in a roof truss system.

Tie-rod channel 130 is defined to receive a tie-rod 140. As illustrated in FIGS. 1–4, tie-rod 140 passes through the tie-rod channel 130 along secondary axis 130'. Tie-rod 140 is secured in channel 130 by a nut 145 which may screw onto the end of the tie-rod 140 at the distal end of channel 130. If tie-rod channel is made by casting, channel 130 is cast with internal threads corresponding external threads on tie-rod 140, and, instead of having a nut 145, the distal end of channel 130 comprises an end wall 144 against which tie-rod 140 is screwed. See FIG. 3A. Tension can be applied between tie-rods by utilizing known tension or torquing devices, mechanisms or couplers between brackets 120 (not illustrated).

A bearing plate 150 is positioned non-coplanar to the primary axis. Plate 150 receives sleeve 125 through plate opening 151. Plate 150 bears and distributes the forces created by the mine strata 105 or any other force placed upon the mine roof support bracket 120.

Figure 5:
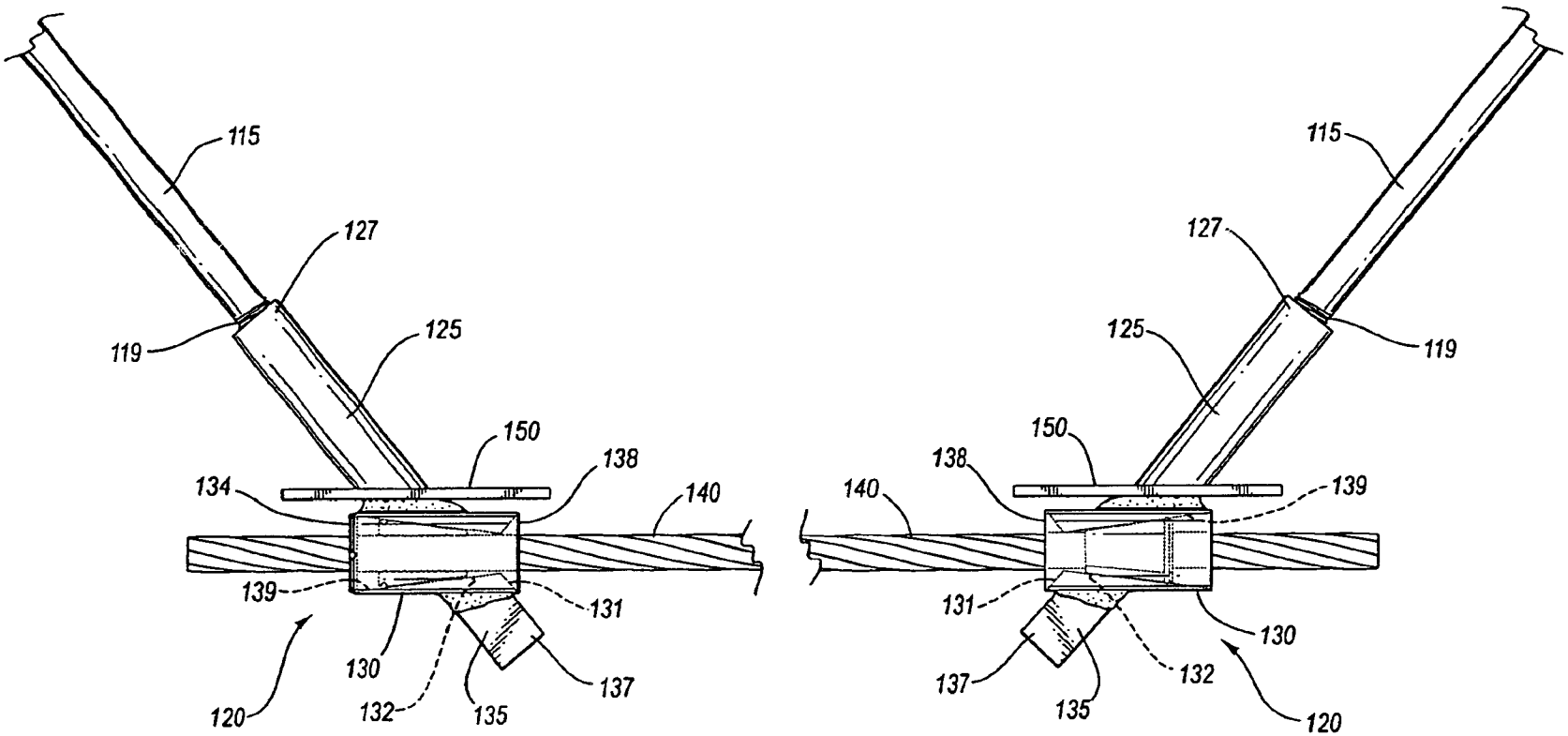
FIG. 5 illustrates a perspective view of an alternative embodiment of the present invention.
Figure 6:
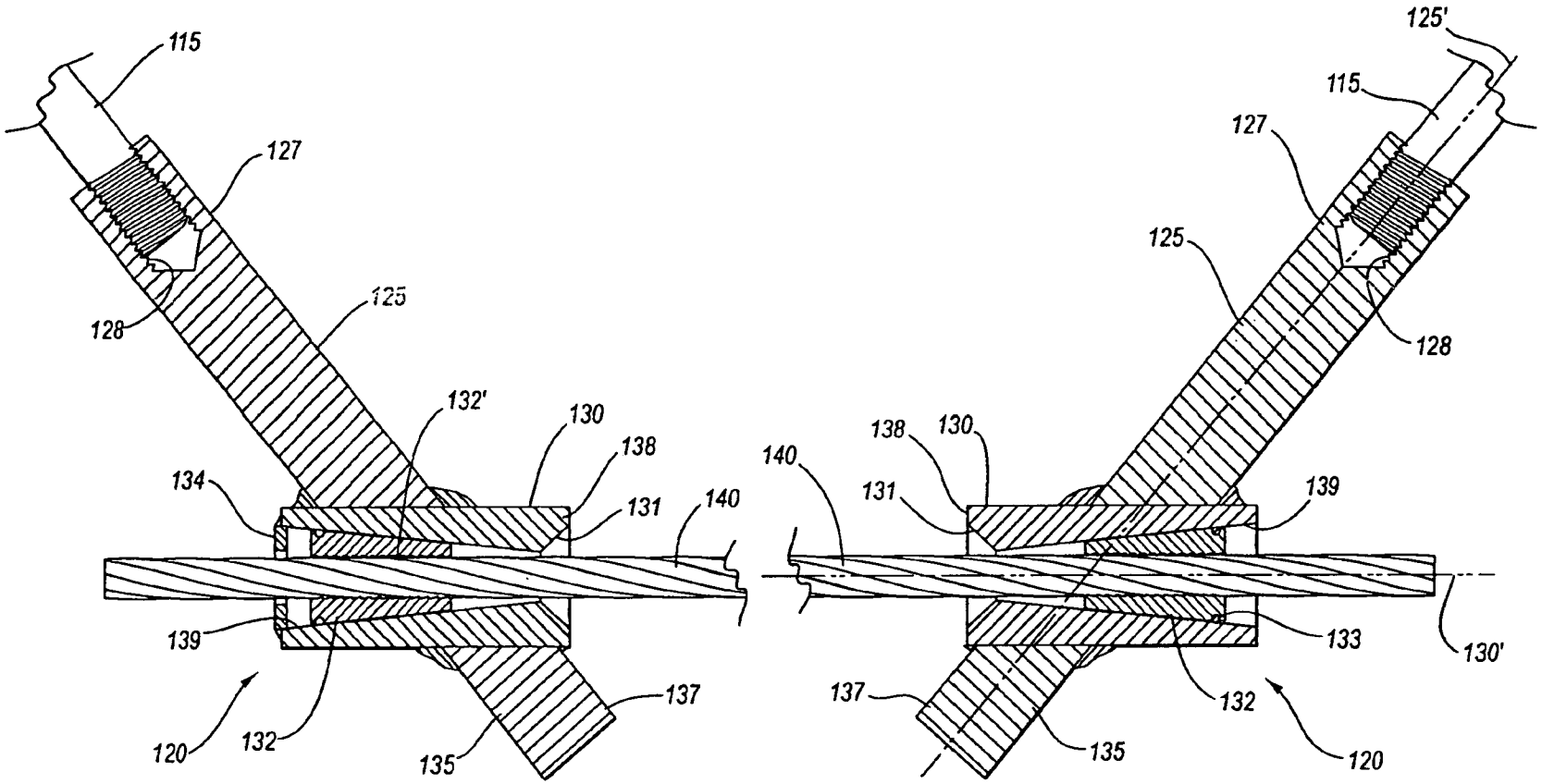
FIG. 6 illustrates a cross-sectional view of the apparatus of FIG. 5.
Figure 7:
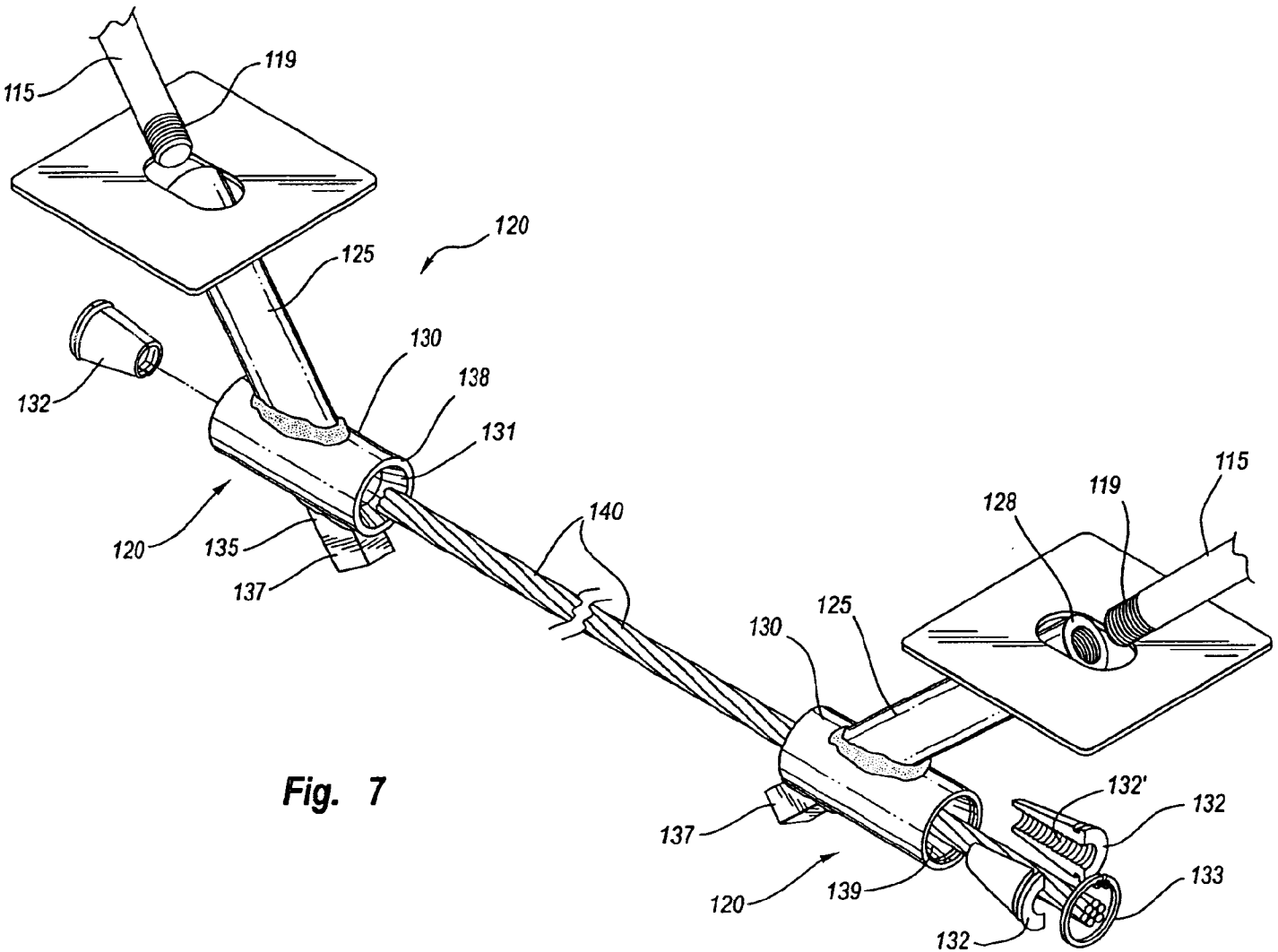
FIG. 7 illustrates an exploded view of the truss structure of the alternative embodiment of FIGS. 5–6 utilized in a roof truss system.

Referring to FIGS. 5–7 an alternative embodiment of the present invention is depicted. The invention comprises a mine roof support bracket 120 comprising a roof bolt sleeve 125 along a primary axis 125' and one end defining a terminal end 137 selectively and releasably coupleable to an insertion tool or equipment as previously discussed. Sleeve 125 further comprises a receiving end 127, which can selectively couple to roof bolt 115 as previously described.

Again bearing plate 150 is positioned to bear and distribute forces from the mine strata 105 or by a force placed upon the mine roof support bracket 120.

Bracket 120 further comprises a tie-rod channel 130 along axis 130', which may be substantially parallel to bearing plate 150, but is angled to the sleeve 125. Tie-rod channel 130 comprises a receiving member 138 defining an insertion cant 131 at the proximal end of channel 130. Receiving member 138 receives tie-rod cable 140. Tie-rod cable 140 is typically made of steel. Tie-rod channel 130 further comprises a wedge cant surface 139. To secure tie-rod 140, caming wedge 132 is placed around tie-rod 140 and then inserted into tie-rod channel 130 so as to rest against wedge cant surface 139. Tie-rod 140 is then placed in tension with the caming wedge 132 abutting wedge cant surface 139, thus securing tie-rod 140 in a secure position.

To increase the security of the relation of cable 140 in the tie-rod channel 130, the surface of caming wedge 132 abutting tie-rod 140 is serrated. Such serrated surfaces 132' essentially bite into abutting tie-rods thus improving the security of the tie-rod's position in tie-rod channel 130; the greater the tension on the cable the stronger caming wedge 132 grips tie-rod 140. Caming wedge 132 is typically made of a metal harder than tie-rod 140. The amount of tension placed on the cable 140 may be adjusted between brackets using techniques and devices commonly known in the art.

To prevent caming wedge 132 from coming loose from the mine roof support bracket 120, a securing ring 133 may be placed on one end of caming wedge 132 securing caming wedge 1;32 in tie-rod channel 130. In the alternative, a tie-rod channel retaining cap 134 may be used to secure wedge 132 in channel 130.

Figure 9:
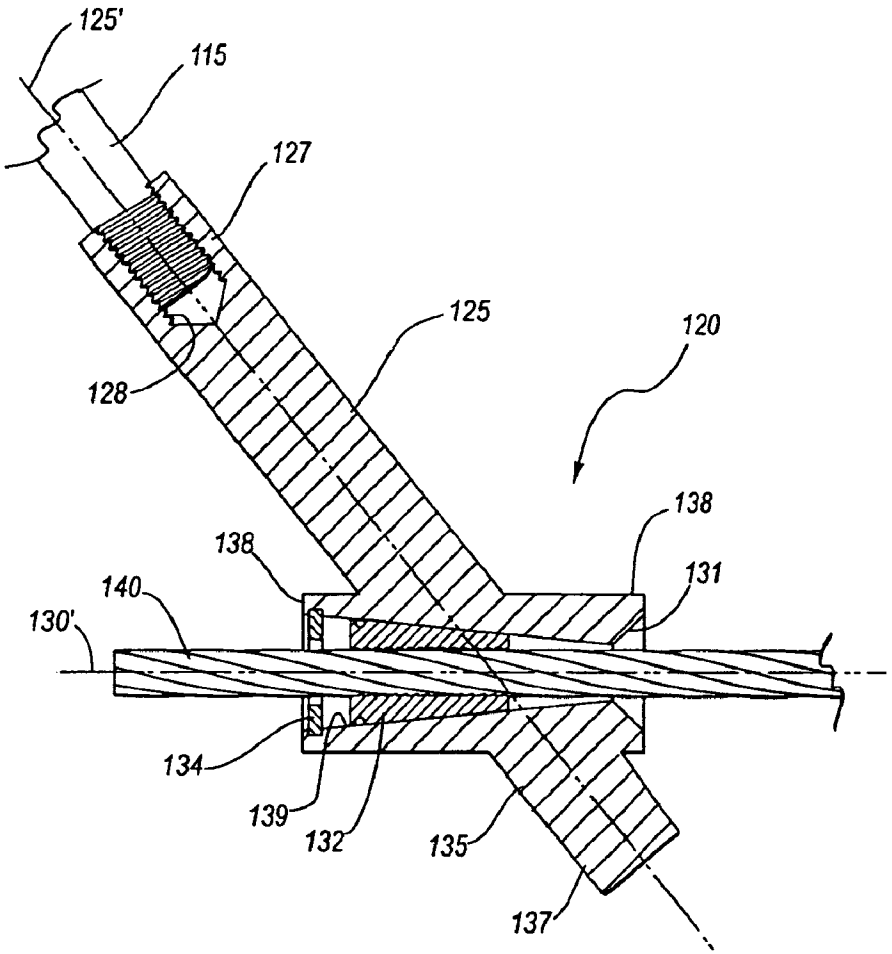
FIG. 9 illustrates a cross-sectional view of FIG. 8.
Figure 8:
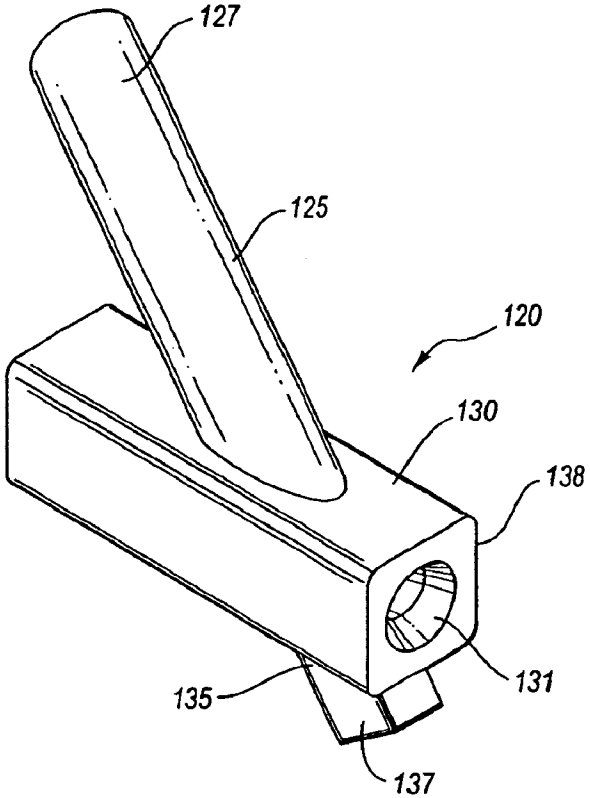
FIG. 8 illustrates an alternative embodiment of the present invention.
Figure 11:
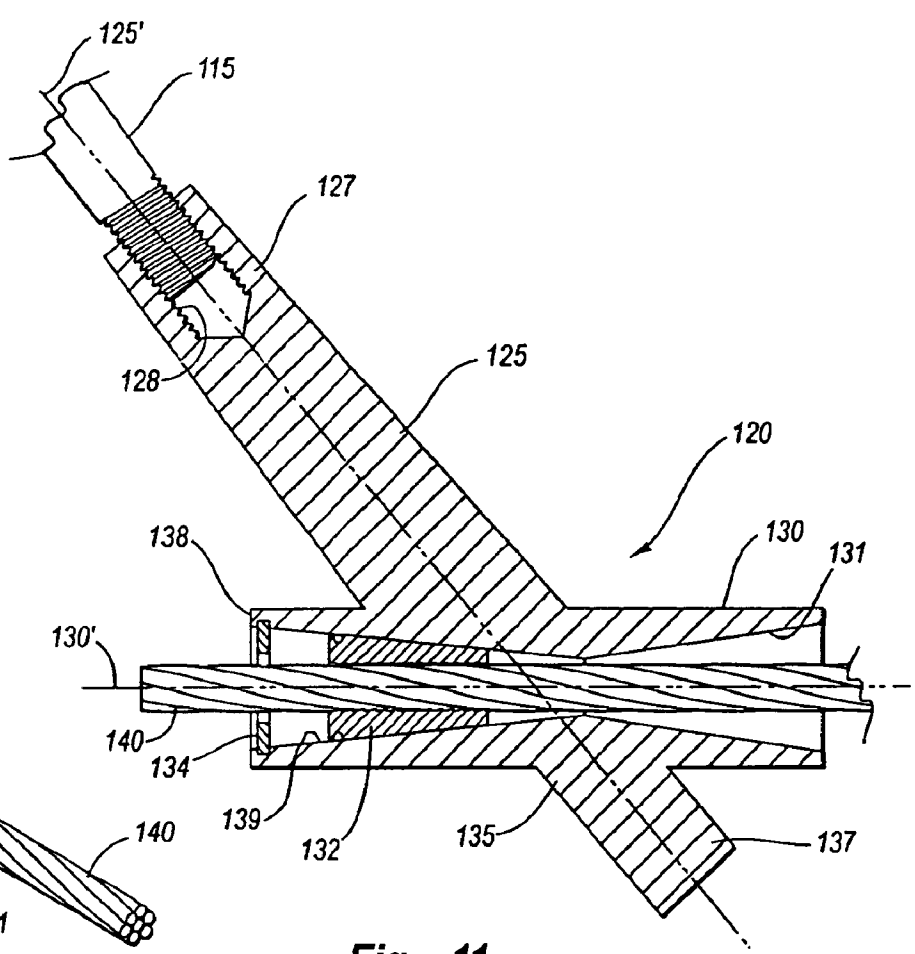
FIG. 11 illustrates a cross-sectional view of FIG. 10.
Figure 10:
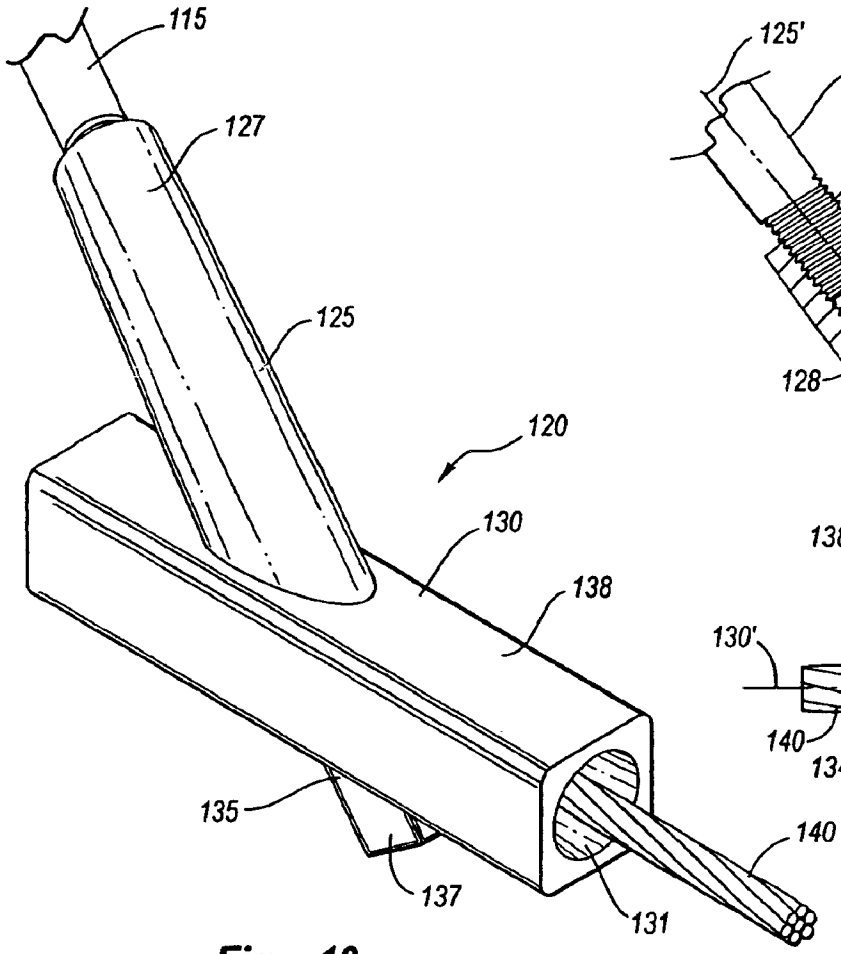
FIG. 10 illustrates an alternative embodiment of the present invention.
Figure 13:
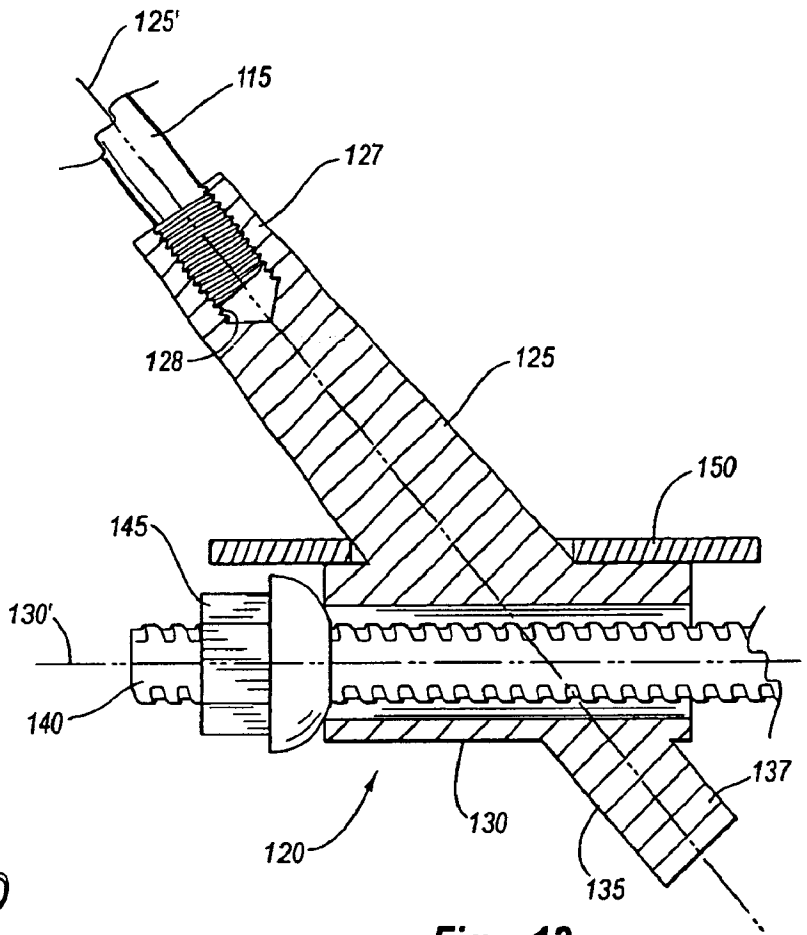
FIG. 13 illustrates a cross-sectional view of the an alternative embodiment of the present invention.
Figure 12:
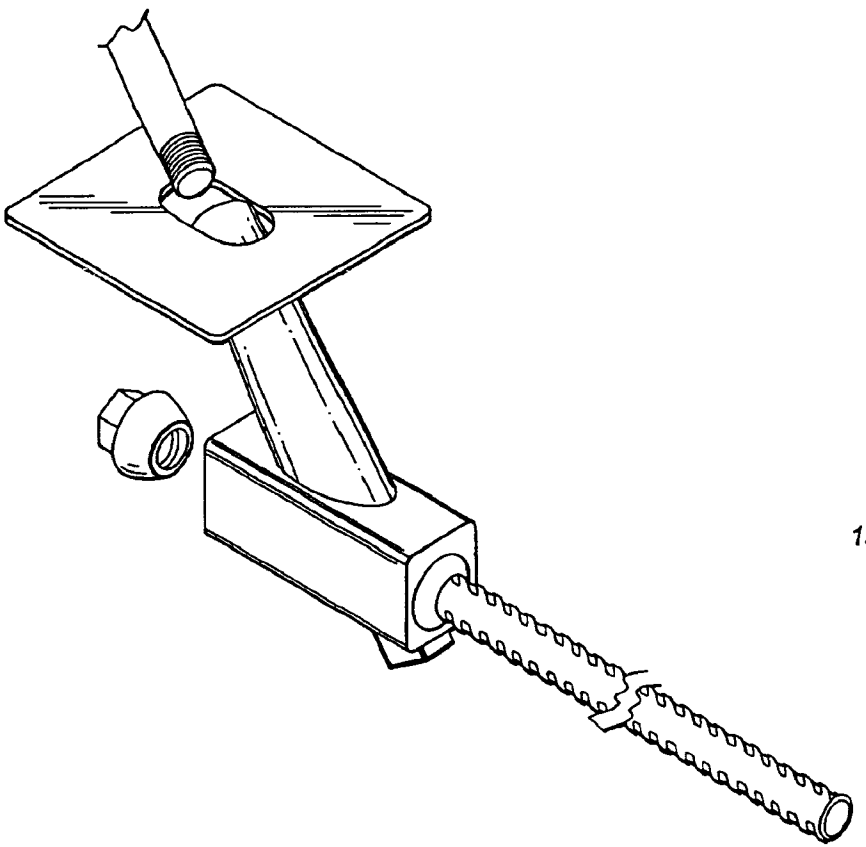
FIG. 12 illustrates an exploded view of an alternative embodiment of the present invention.

Referring to FIGS. 3 and 9, the bracket 120 may be formed using casting techniques commonly known in the art, and may be in the form of an elongated cube, a cylinder, or an elongated polygon. Caming wedge 132 may be of a length sufficiently short to allow the wedge to be concealed inside tie-rod channel 130.

Referring to FIGS. 10, 11, 12, and 13, the invention teaches flaring sleeve 125 from a narrower diameter at the threaded end 127 to a broader diameter where the sleeve 125 is fixed to tie-rod channel 130. When the flared bolt sleeve 125 is inserted into a pre-drilled hole 110, the flaring functions to center bracket 120 in hole 110 upon insertion thereby improving the contact with and stability of bracket 120 in hole 110.

Figure 14:
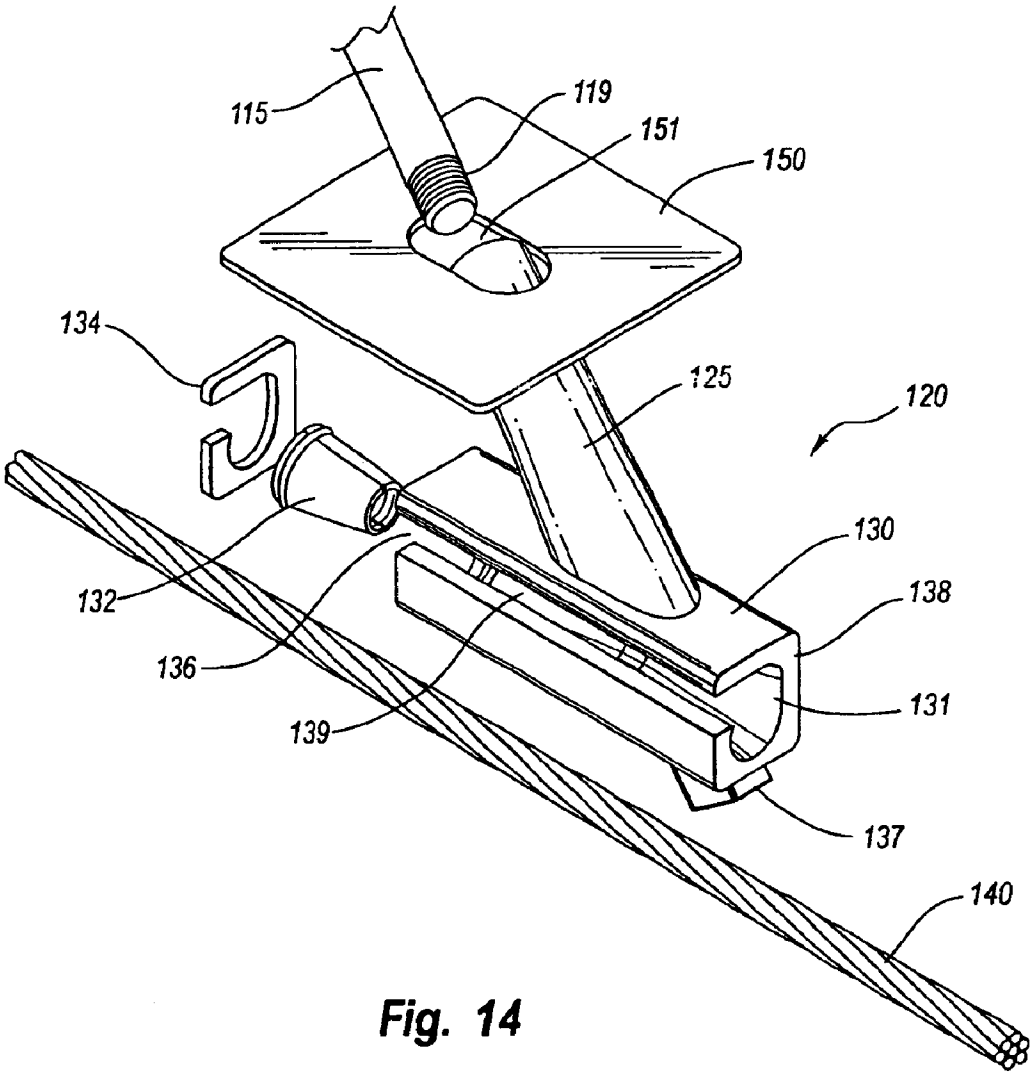
FIG. 14 illustrates an exploded view of an alternative embodiment of the present invention.

Referring to FIG. 14, an exploded view of an alternative embodiment of the present invention illustrating a slot 136 extending along the medial side of tie-rod channel 130. Slot 136 allows tie-rod cable 140 to be placed in channel 130 and secured therein with caming wedge 132. End cap 134 ensures that wedge 132 is retained in channel 130. The present invention teaches that bracket 120 may be placed at any point along the length of tie-rod 140 to improve or aid in supporting mine strata 105.

Having described these aspects of the invention, it is understood that the invention defined by the appended claims is not to be limited by particular details set forth in the above description, as many apparent variations thereof are possible without departing from the spirit or scope thereof.

I claim:

1. A mine roof support bracket comprising:

a roof bolt receiving sleeve along a first axis;

a tie-rod receiving channel along a second axis and integrally fixed to the roof bolt receiving sleeve; and a tool mount extending along the first axis opposite the sleeve.

2. The bracket of claim 1 wherein the sleeve comprises an end to receive a roof bolt a distance from the tool mount.

3. The tool mount of claim 1 comprising a terminal end releaseably coupleable to a mine tool used to insert roof bolts.

4. The tie-rod receiving channel of claim 1 wherein the channel comprises an insertion cant at the proximal end of the channel.

5. The tie-rod channel of claim 1 further comprising a lateral slot along the tie-rod channel.

6. The tie-rod channel of claim 5 wherein the lateral slot can receive a tie-rod bar.

7. The tie-rod channel of claim 5 wherein the lateral slot can receive a tie-rod cable.

8. The receiving sleeve of claim 1 wherein the diameter of sleeve increases toward the tie-rod channel.

9. A combination mine roof support bracket and roof bolt apparatus comprising:

a roof bolt receiving sleeve along a first axis;

a tie-rod receiving channel along a second axis and integrally fixed to the roof bolt receiving sleeve;

a tool mount extending along the first axis opposite the sleeve; and a roof bolt coupled in the sleeve.

10. The apparatus of claim 9 wherein the sleeve comprises an end to receive a roof bolt a distance from the tool mount.

11. The tool mount of claim 9 comprising a terminal end releaseably coupleable to a mine tool used to insert roof bolts.

12. The tie-rod receiving channel of claim 9 wherein the channel comprises an insertion cant at the proximal end of the channel.

13. The tie-rod channel of claim 9 further comprising a lateral slot along the tie-rod channel.

14. The tie-rod channel of claim 13 wherein the lateral slot can receive a tie-rod bar.

15. The tie-rod channel of claim 13 wherein the lateral slot can receive a tie-rod cable.

16. The receiving sleeve of claim 9 wherein the diameter of sleeve increases toward the tie-rod channel.

17. A mine roof truss comprising:

a plurality of mine roof support brackets, each bracket comprising a roof bolt receiving sleeve along a first axis, a tie-rod receiving channel along a second axis and integrally fixed to the roof bolt receiving sleeve, and a tool mount extending along the first axis opposite the sleeve;

a roof bolt coupled to each sleeve; and a tie-rod coupled to each channel.

18. The truss system of claim 17 wherein the roof bolts and tie-rods comprise steel bars.

19. The truss system of claim 17 wherein the tie-rods comprise steel cables.

20. The truss system of claim 17 further comprising a torquing mechanism to join tie-rods between brackets.

* * * * *